United States Patent [19]

Ikeda

[11] 3,963,880

[45] June 15, 1976

[54] MOVING COIL-TYPE CARTRIDGE

[75] Inventor: Isamu Ikeda, Tokyo, Japan

[73] Assignee: Fidelity-Research Inc., Tokyo, Japan

[22] Filed: Apr. 9, 1975

[21] Appl. No.: 566,247

[30] Foreign Application Priority Data

July 24, 1974 Japan ..... 49-85387
Sept. 6, 1974 Japan ..... 49-106568[U]

[52] U.S. Cl. ..... 179/100.41 D; 179/100.41 K
[51] Int. Cl.[2] ..... H04R 9/12
[58] Field of Search ..... 179/100.41 D, 100.41 K

[56] References Cited

UNITED STATES PATENTS

| | | | |
|---|---|---|---|
| 2,148,796 | 2/1939 | Barbieri | 179/100.41 D |
| 3,020,361 | 2/1962 | Minter | 179/100.41 D |
| 3,207,857 | 9/1965 | Poutot | 179/100.41 D |

*Primary Examiner*—Alfred H. Eddleman
*Assistant Examiner*—Jay P. Lucas
*Attorney, Agent, or Firm*—Leydig, Voit, Osann, Mayer & Holt, Ltd.

[57] ABSTRACT

An improved moving coil-type phonograph cartridge producing reliably higher output and being easily manufactured is provided. Moving coils disposed in the center of a gap in magnetic circuit of permanent magnet and pole pieces is supported rotatably about a fulcrum positioned out of coil bobbin and an axial line of the gap so that coil sections on remote side from the fulcrum will transverse magnetic fluxes in the gap with a larger rotation radius and at a higher velocity than those of the other coil sections on fulcrum side. Further, at least a pole piece on the fulcrum side has a cavity surrounding the fulcrum so that the fluxes will be distributed to be circumferentially away from the fulcrum whereby the coil sections on the fulcrum side will be disposed out of the fluxes. Electromotive force eventually produced in the coil sections on the remote side from the fulcrum is larger than that produced in the other sections so that effectively and reliably higher output can be obtained.

23 Claims, 7 Drawing Figures

MOVING COIL-TYPE CARTRIDGE

This invention relates generally to phonograph cartridges and, more particularly, to improvements in such cartridges of moving coil type.

Generally the cartridges of the moving coil type (which shall be referred to as MC-type cartridges hereinafter) have been excellent in frequency characteristics but defective in that their output has been smaller as compared with cartridges of moving magnet type (MM-type cartridges). In FIG. 1, there is shown a general structure of the MC-type cartridges for reproducing stereo sound, in which 101 is a base member consisting of a synthetic resin mold, 102 is a permanent magnet secured to said base member by means of a bonding agent, 103 is a pair of pole pieces respectively secured to each of different polarity ends of the permanent magnet 102, 104 is a bobbin having coils would therearound and supported within a gap between the respective pole pieces 103 by means of dampers 105, and 106 is a cantilever of a rod shape having at an end a stylus and fixed at the other end to the center of a side wall of the bobbin 104. In the MC-type cartridges of the structure of the kind as illustrated, the fixing position of the cantilever 106 to the bobbin 104 is made to be on the central axis of the bobbin which intersecting at right angles distribution direction of magnetic fluxes between the respective pole pieces 103 so that the center of rotations of the coils on the bobbin 104 responsive to variations of sound record groove in its width on phonograph disk (not shown) will be coincided with actual center of the coils, whereby rotational moving directions of respective coil sections facing each pole piece will be opposite to each other with respect to the flux direction and rotary radiuses of such coil sections will be substantially equal to one another, consequent to which electromotive forces substantially of the same magnitude and mutually of opposite polarities will be produced in the respective said coil sections, and electric currents generated due to such forces in the respective coil sections will be superposed on each other so as to be obtained at output ends of the coils as an output of the cartridge. In practice, however, it is very difficult to have the coil center and rotary center of the bobbin and coils coincided with each other on physical and manufacturing technological viewpoints, for example, due to possible errors in dimensions of the respective dampers for supporting the coil bobbin and, even when the coincidence of the coils' and their rotary centers with one another is achieved, the radius of the coil rotation is thereby limited to be small anyhow, so that the obtained electromotive forces and consequential output of the coil will be inherently limited to be small. It may be possible to render the coil rotation radius to be larger by increasing, for example, the thickness of the bobbin in the direction of fluxes flowing. In this case, however, it becomes necessary to enlarge the gap between the pole pieces and, consequent thereto, it will be unavoidable that the size and weight of the cartridge have to become larger as a whole, and that the magnetic field intensity in the gap is weakened and thus the electromotive forces to be obtained are ill influenced. The present invention has been suggested in view of such defects in conventional MC-type cartridges and thus to provide an improved MC-type cartridge wherein the coil rotation center is positioned outside the coil bobbin so as to enlarge the coil rotation radius while rendering the manufacture thereof to be easy and further the distribution of the magnetic fluxes is caused to vary with reference to the coil roration axis so as to be able to obtain effectively large electromotive forces.

A principal object of the present invention is, therefore, to provide an MC-type cartridge which can be manufactured easy and yet is capable of obtaining higher outputs.

Another object of the present invention is to provide an MC-type cartridge of which reliability is high with less fluctuations in output performances.

Other objects and advantages of the present invention will be made clear upon reading the following explanation of the present invention detailed with reference to certain preferred embodiments thereof as shown in accompanying drawings, in which.

Figure 1:
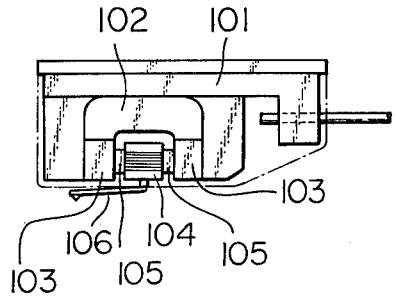
Fig. 1 (PRIOR ART)
FIG. 1 is a side elevation with a part removed of an exemplary one of conventional MC-type cartridges.
Figure 2:
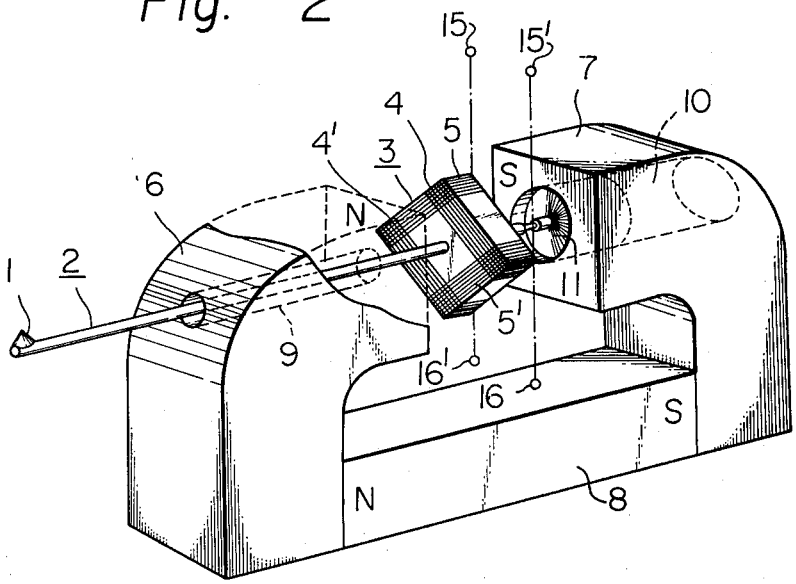
FIG. 2 is a perspective view with a part removed of a preferred embodiment in somewhat magnified scale of an MC-type cartridge specifically for stereo recorded-sound reproducing use according to the present invention.
Figure 4:
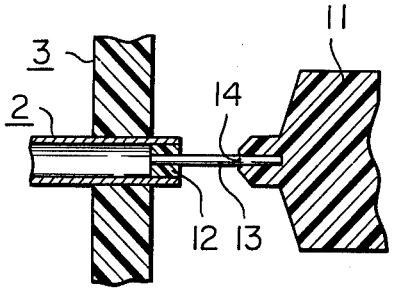
Figure 5A:
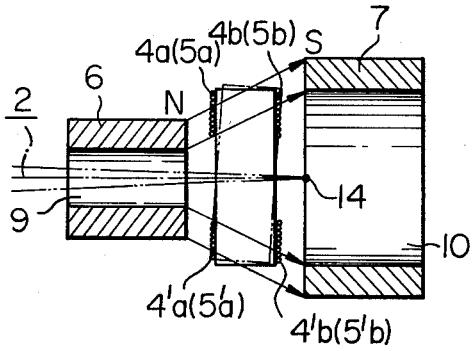
Figure 5B:
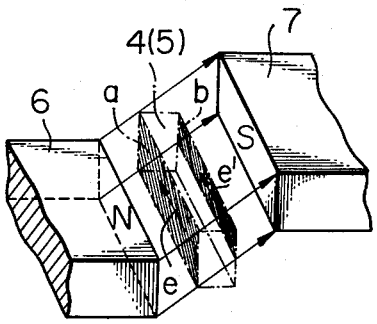
Figure 6:
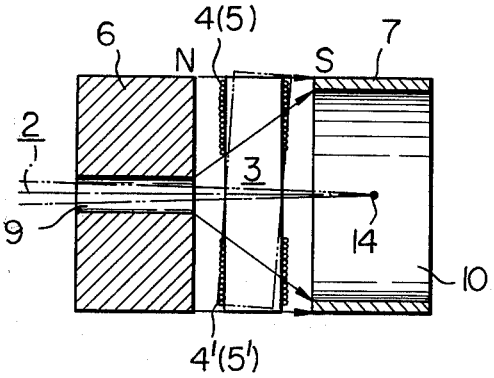

FIG. 4 is a fragmentary magnified section showing a support mechanism for coil bobbin in the embodiment of FIG. 2; and FIGS. consisting of 5A and 5B, and 6 are explanatory views for showing schematically basic operational principle of the present invention in its different aspects, wherein FIG. 5A is a fragmentary magnified section at the part of the pole pieces and coil bobbin in an aspect, FIG. 5B is a schematic perspective view of a part thereof, and FIG. 6 is a similar section to FIG. 5A showing the other aspect.

Figure 3:
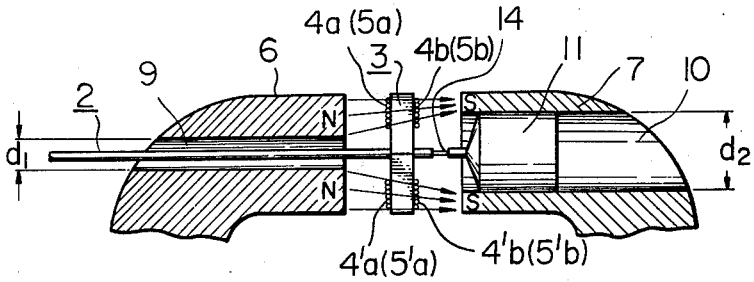
FIG. 3 is a sectioned view of a main part of the embodiment shown in FIG. 2.

Referring now to FIGS. 2 and 3 showing the most preferrable embodiment of the present invention, a stylus 1 is secured at a tip of a cantilever 2 of a nonmagnetic material in the present instance, a coil bobbin 3 substantially in a square box shape of a nonmagnetic and electrically insulative material is fixed at its central axis to the cantilever 2 adjacent the other end of the same, and two pairs of coils 4, 4' and 5, 5' for coordinating with right and left channels in stereo record groove in the present instance are wound respectively adjacent each peripheral edge of the bobbin 3 so that each of the pair of coils 4 and 4' or 5 and 5' will be in parallel with one another. The respective coils 4 and 4' or 5 and 5' of each pair are connected with each other in series, and the respective ends of the coil pairs 4, 4' and 5, 5' are forming output terminals 15, 15' and 16, 16', respectively. Pole pieces 6 and 7 made of a magnetic material are respectively formed substantially in an L-shape and are disposed so as to hold at a side surface adjacent one end of them a bar-shaped permanent magnet 8 and to form a magnetic gap in a magnetic circuit of the pole pieces 6 and 7 and permanent magnet 8 between opposing the other end surfaces of the respective bent parts. These bent parts of the pole pieces 6 and 7 forming the magnetic gap are provided with through holes 9 and 10, respectively, which are extending along central axis of the gap. The cantilever 2 penetrates through the hole 9 so as to extend at its end having the stylus 1 out of the pole piece 6 while positioning the coil bobbin 3 at the center of the magnetic gap. The cantilever 2 is supported in position by means of a support member 11 made of a nonmagnetic material and fixedly fitted in the hole 10 in the other pole piece 7, in such that the other end of the cantilever 2 adjacent which the bobbin 3 is supported is fixed to the center of the member 11.

There is shown in FIG. 4 detailes of an example of the above referred supporting structure of the cantilever 2 and coil bobbin 3, in which the cantilever 2 consists of a hollow pipe in the present instance, a filler member 12 made of a nonmagnetic material and having a central hole is fitted tightly in the hollow end of the cantilever 2 extending out of the bobbin 3, and such a string 13 having a proper resiliency as a piano wire is fixed at an end in the central hole of the filler 12 and at the other end in a central hole of the support member 11 fixed in the pole piece 7. Therefore, the cantilever 2 with the coil bobbin 3 is supported on the aligned central axes of the hole 9 in the pole piece 6 and of the magnetic gap in a manner rotatable about a fixing base point 14 of the string 13 as fulcrum.

That is, in the operation of the embodiment of FIGS. 2 and 3, the coil bobbin 3 is to be rotated about the fulcrum 14 which is positioned at an external point extended out of the central axis of the bobbin 3 in the direction in which magnetic fluxes flow from the pole piece 6 to the opposing pole piece 7 since in the present embodiment the pole piece 6 through which the cantilever 2 penetrates is magnetized in N-pole and the other pole piece 7 on the fulcrum side of the cantilever 2 as shown, in response to variations of the width of sound recorded groove which the stylus 1 traces. Therefore, the rotation radius of the respective coil sections 4*a*, 4′*a* and 5*a*, 5′*a* (see FIG. 3) of the respective coils on the bobbin 3 which are positioned on the side remote from the fulcrum 14 of the bobbin 3 is caused to be larger than that of another coil sections 4*b*, 4′*b* and 5*b*, 5′*b* positioned on the side closer to the fulcrum 14, consequent to which the intersecting velocity of the coil sections 4*a*, 4′*a* and 5*a*, 5′*a* through the fluxes in the gap in each rotation becomes larger than that of the coil sections 4*b*, 4′*b* and 5*b*, 5′*b*. If the respective rotation radiuses of the respective coil sections are the same with each other and hence the intersecting velocities are also the same, the magnitude of electromotive forces generated in such coil sections will be also the same on the respective sides of the bobbin and there can be obtained none of output at the coil terminals since the directions of electric currents produced are identical on the both sides. According to the present invention, on the other hand, it is possible to obtain an output at the coil terminals due to the difference in the velocities of the respective coil sections on both sides of the bobbin at which the coils intersecting the magnetic fluxes in the gap, even though the directions of the electric currents resulting from the electromotive forces generated in such coil sections are the same with each other, since the electromotive forces generated in the coil sections 4*a*, 4′*a* and 5*a*, 5′*a* on the side remote from the coil rotation fulcrum 14 are larger than those generated in the coil sections 4*b*, 4′*b* and 5*b*, 5′*b* on the other side due to the difference in the flux intersecting velocities.

In order to improve such effect of the particular fulcrum positioning as described above, in the embodiment of FIGS. 2 and 3, the diameter $d_1$ of the hole 9 in the pole piece 6 is made smaller than the diameter $d_2$ of the hole 10 in the opposing pole piece 7, while outer diameters of the both pole pieces are substantially the same. With this arrangement, the magnetic fluxes flowing from the pole piece 6 magnetized to be N-pole to the pole piece 7 magnetized to be S-pole are caused to be distributed in such that, as shown in FIG. 3, the fluxes in the outer peripheral part in the gap will be parallel to the central axis of the magnetic gap but the fluxes in the inner part will be gradually converged outward at the side of the pole piece 7 as they approach the central axis so as to pass more diagonally through the bobbin 3. Consequently, the coil sections 4*a*, 4′*a* and 5*a*, 5′*a* which facing the pole piece 6, i.e. N-pole, are almost all positioned inside the magnetic fluxes whereas the other coil sections 4*b*, 4′*b* and 5*b*, 5′*b* facing the pole piece 7, i.e. S-pole, are only partly positioned inside the fluxes with certain parts of them positioned outside the fluxes. That is, the respective coil sections facing the N-pole are disposed in the fluxes so that almost all of them will be effective to generate the electromotive force but those facing the S-pole are disposed so that they will be only partly effective to generate such force.

FIGS. 5A and 5B are to show a basic aspect of such flux distribution as described above. It should be appreciated here that, while in the embodiment of FIGS. 2 and 3 there is shown a case where the pole pieces having the same outer diameters but different inner diameters are employed, both the outer and inner diameters may be made larger on the S-pole side of the pole piece 7 as shown in FIG. 5A under the basic principle of the present invention, while the wall thickness of the both pole pieces is kept substantially equal. In this case, the magnetic fluxes flowing from the N-pole to the S-pole are not converged at the S-pole side but, as shown by respective two parallel arrows, they are directed outward at the side of the fulcrum 14 with respect to the central axis of the magnetic gap which is here represented by a chain line 2 denoting axial line of the cantilever 2, so that the fluxes will pass all diagonally through the coil bobbin 3, whereby there are caused certain parts of the coil sections 4*b*, 4′*b* and 5*b*, 5′*b* on the S-pole side to be positioned outside the fluxes consequentially, in the same manner as in the case of FIGS. 2 and 3 and thus the same effect can be achieved.

FIG. 5B is a perspective view of an upper half part of FIG. 5A with the respective pole pieces shown schematically in flat plate shape for simpler explanation. In the drawing, the diagonal magnetic fluxes as defined by four arrows pass diagonally through each coil 4 or 5 defined by chain lines so as to enclose in the fluxes substantially all of the coil section on the N-pole side represented by a hatched area *a* but to allow only such a part of the other section on the S-pole side as represented by a hatched area *b* to be enclosed in the fluxes. It will be here understood that, when the coil is moved within the fluxes in vertical direction in the drawing, the electromotive forces of the same direction denoted by arrows *e* and *e*′ are generated in the respective hatched parts *a* and *b* effective to generate such electromotive forces of the coil sections facing the N and S poles, respectively, and that the effective part *a* is much larger in the area and hence in the number of coil turns than the other effective part *b*. For this reason, the generated electromotive forces *e* and *e*′ of the same direction will be caused to have a relation $e > e'$ and, consequently, an output corresponding to their difference $e - e'$ is obtained.

It is thus possible to generate effective electromotive forces similarly to the case where the rotation fulcrum of the coil bobbin is positioned outside the bobbin, also by constructing the magnetic gap in such manner that, as has been described above, the magnetic fluxes in the gap between the pole pieces will flow in the directions in which they will be away from the coil rotation fulcrum and thus will be diagonal with respect to the coils at least in the range closer to the central axis of the coil bobbin positioned at the center of the gap. The effect obtained by such magnetic gap construction enables it possible to obtain a larger cartridge output in conjunction with the effective electromotive forces obtained as a result of the difference in the rotation radiuses of the respective coil sections on both sides of the bobbin.

FIG. 6 shows in the similar sectional view to FIG. 5A an aspect of the present invention wherein substantially the same magnetic gap construction as in the embodiment of FIGS. 2 and 3 is employed. In this aspect of FIG. 6, the difference in the inner hole diameters of the respective pole pieces 6 and 7, that is, the difference of the diameter of the hole 9 in the pole piece 6 from that of the hole 10 in the other pole piece 7, is made as large as possible, whereas the outer diameters are made identical with each other. This will result in that the magnetic fluxes from the N-pole 6 to be remarkably converged toward the narrow end surface of the S-pole 7 so that the fluxes in the range closer to the central axis of the bobbin will pass through the coils diagonally at larger angles with respect to the axis. The coil sections on the N-pole side of the bobbin are thereby caused to be exposed to the fluxes having much wider distribution range and, on the other hand, the coil sections on the S-pole side are to be exposed only to the fluxes of much narrower distribution range. Therefore, it becomes possible to wind the coils on the bobbin with much more turn number than in the case of FIGS. 2 and 3 or of FIG. 5 so that the difference between the respective electromotive forces $e$ and $e'$ generated on the N-pole and S-pole sides will be remarkably larger, whereby it is made possible to obtain a larger output.

Further, in the case where the supporting fulcrum 14 for the cantilever 2 and thus the rotation center of the coil is provided at a more remote position as shown in FIG. 6 than in the cases of FIGS. 2 and 3 and FIG. 5, it is possible to have the rotation radius of the coils enlarged. In practice, however, the maximum rotation radius specifically at the position of the stylus on the tip of the cantilever is determined by the width of the sound recorded groove and, therefore, as regards the effect of the fulcrum positioning at more remote point from the bobbin, it should be noted that rotational directions of the whole coils can be made more closer to directions intersecting at right angles the central axial line common to the cantilever and coils in their stationary position than in the case in which the fulcrum is closer to the coil bobbin. Consequent to this fact, the respective coil sections facing the N and S poles can be moved to intersect the magnetic fluxes at an angle closer to the right angle with respect to the flux flowing directions and, further, the coil sections specifically on the N-pole side which having larger rotation radius are provided with optimum conditions effective to produce larger electromotive forces therein as compared with those sections on the S-pole side since converging degree of the fluxes to which the N-pole side coil sections are exposed is smaller and thus more fluxes are substantially parallel to the magnetic gap axis than on the S-pole side, so that the desired effect of the invention becomes more remarkable.

While the explanation has been made with reference to the particular arrangement of the foregoing embodiments wherein the fulcrum 14 for the coil bobbin 3 is disposed outside the bobbin on the S-pole side and the magnetic fluxes flowing through the magnetic gap from N-pole of the pole piece 6 to S-pole of the other pole piece 7 are distributed so as to be away from the fulcrum 14 in said position as the fluxes approach the fulcrum, this is for the reason that the provision of the fulcrum 14 at the above described position, in other words, on the side opposit to the tip on which the stylus 1 is provided of the cantilever 2 with respect to the coil bobbin 3 is more advantageous in the practical manufacturing of the cartridge. Theoretically, it is possible to provide the fulcrum or supporting point 14 of the cantilever 2 on the same side with the stylus 1 with respect to the coil bobbin 3. In this case, it is necessary to render the inner diameter of the N-pole side pole piece 6 to be larger and also the inner diameter of the S-pole side pole piece 7 to be smaller in contrast to the foregoing embodiments so that the magnetic fluxes will be distributed so as to be away from the fulcrum 14 in the region adjacent the fulcrum and will approach the central axial line while flowing through the gap and the cantilever as well as the bobbin, as the fluxes advance away from the fulcrum. With this arrangement, the effect that the electromotive forces generated in the coil sections on a side of the bobbin 3 which is, in this case, the side facing the S-pole may be made larger than those generated on the other side can be achieved.

While in the foregoing the present invention has been explained mainly with reference to the illustrated embodiments, the intention is not to limit the invention only to those aspects shown but is rather to cover all modifications, alternatives and equivalent arrangements to be included in the scope of appended claims.

For example, the embodiment shown in FIG. 2 represents an aspect which is considered most advantageous in the viewpoint of manufacturing and utility in practising the present invention, in which the pole pieces 6 and 7 are shown as having substantially an L-shape. However, it will be readily appreciated that the magnetic circuit may be properly constituted with elements including the pole pieces and the permanent magnet as well of other shapes and in any other arrangement than those shown, as long as the basic principle of the present invention explained with reference to FIGS. 5 or 6 is performed.

Further, the MC-type cartridge according to the present invention is not necessarily restricted to the one for stereo recording or reproducing. Rather, the present invention is applicable also to the cartridge for monoral recording and reproducing when the coil structure and arrangement are properly modified.

In the respective embodiments described, further, the cantilever has been referred to as being in the form of straight rod or pipe and passed through a hole in one of the pole pieces respectively having the through hole. However, it is not necessary to form and dispose the cantilever and pole pieces always as disclosed but is possible to provide such hole only in one of the pole pieces on the side of the supporring fulcrum for the coil bobbin and cantilever as long as the stylus on the cantilever can be positioned out of the magnetic gap in any proper manner.

What is claimed is:

1. An moving coil-type cartridge comprising a cantilever of a nonmagnetic material and having at an end a stylus, a bobbin made of a nonmagnetic and electrically insulative material including mutually parallel two surfaces and mounted at least adjacent the other end of said cantilever along an axis passing substantially through the center of said two surfaces, at least a pair of coils wound on said bobbin so as to have substantially parallel sections respectively disposed on each of said two surfaces and intersect one another, means of a nonmagnetic material for supporting said cantilever at a fulcrum position thereof for allowing said stylus and bobbin to rotate in synchronism with each other, a magnetic circuit which comprises a permanent magnet and a pair of pole pieces respectively arranged so that one end thereof will be magnetically coupled to each of N-pole and S-pole ends of said permanent magnet and polarized the other end will form a magnetic gap between one another, said bobbin being positioned substantially at the center of said magnetic gap so that the two parallel surfaces will oppose said the other ends of the pole pieces, respectively, and a base member of a nonmagnetic material to which said magnetic circuit is secured at least at said permanent magnet and having an electric terminal connected to both ends of said coils, said supporting means for said cantilever being fixed to one of said pair of pole pieces so that said fulcrum will be disposed substantially on the axial line of the magnetic gap, and said polarized end at least of the pole piece to which said supporting means is fixed having a cavity expanding in all directions around said fulcrum so that magnetic fluxes flowing in the magnetic gap through the coil bobbin will be distributed as converged in said directions so as to be away from the fulcrum, whereby said sections of the coils on one of the two surfaces of the bobbin on the side remote from the fulcrum will be disposed within the fluxes of a larger range than that of the fluxes in which the other coil sections on the side closer to the fulcrum is disposed and, when the bobbin including the coils is rotated about the fulcrum as a center, said coil sections on the side remote from the fulcrum will transverse the fluxes at a larger velocity than the other coil sections.

2. The cartridge according to claim 1 wherein each of said coils is divided into two parts respectively of substantially the same turns and arranged in parallel and symmetrical relation to each other with respect to the axial line of the bobbin, said two parts being connected in series to one another.

3. The cartridge according to claim 2 wherein respective said divided two parts of each coil intersect respective divided parts of the other coil at an angle substantially coinciding with an angle defined by two surfaces of sound recording groove on a sound recording disk.

4. The cartridge according to claim 1 wherein said bobbin is substantially of a plate shape of which said parallel two surfaces are respectively of a square and matching with each other, and each of said coils is divided into two parts respectively of substantially the same turns and arranged in parallel relation to each other as respectively disposed adjacent each edge of said square surfaces, said divided parts of the coils being connected in series to each other.

5. The cartridge according to claim 1 wherein said cavity in the pole piece to which said cantilever supporting means is fixed is a hole extending coaxially with said axial line of the magnetic gap, and said cantilever supporting means is a member of a shape capable of being fitted in said hole and positioning said fulcrum on axial line of said hole.

6. The cartridge according to claim 1 wherein the other pole piece opposing said pole piece having said cavity is provided with a cavity of a smaller diameter than said cavity, and respective said cavities are opposed to each other concentrically with said axial line of the magnetic gap.

7. The cartridge according to claim 6 wherein at least said smaller diameter cavity of the other pole piece is a hole penetrating through said pole piece, and said cantilever is substantially of a linear shape and penetrating through said hole so as to have the stylus positioned out of said the other pole piece.

8. The cartridge according to claim 6 wherein said cavities of the respective pole pieces are substantially cylindrical holes penetrating through the respective pole pieces, and said cantilever supporting means is a cylindrical member fitted in said cylindrical hole of the pole piece to which said means is fixed.

9. An moving coil-type cartridge comprising a magnetic circuit including a magnetic gap formed with two surfaces opposing substantially parallelly and magnetized respectively to be N-pole and S-pole, a bobbin made of a nonmagnetic material and disposed substantially at the center of said magnetic gap and coaxially with central axial line of magnetic fluxes flowing in the gap, said bobbin having at least a pair of coils respectively wound on the bobbin so as to form coil sections respectively transversing at right angles said axial line and separated from one another in the direction of the axial line and to intersect each other on planes in which said sections transverse the axial line, a means made of a nonmagnetic material for supporting said bobbin and disposed adjacent one of said magnetized surfaces so as to allow the bobbin to be rotatable within said magnetic fluxes about a fulcrum positioned on the axial line, and a cantilever made of a nonmagnetic material having a stylus for tracing a groove on a sound recording disk at one end and coupled to said bobbin at the other end so as to rotate in synchronism with said rotation of the bobbin, said magnetic circuit having at least in one of said opposing magnetized surfaces a cavity extending substantially coaxially with said axial line of the magnetic fluxes and having a smaller diameter than that of distributed range of the fluxes, whereby the magnetic fluxes flowing through the coils in the magnetic gap will be distributed to be away from said fulcrum for the bobbin rotation in directions all around the fulcrum and said coil sections on the side remote from the fulcrum will be exposed to a larger range of the fluxes than that for the other sections and will transverse the fluxes at a higher velocity than the other sections when the bobbin is rotated.

10. The cartridge according to claim 9 wherein said magnetic circuit is provided with a further cavity in the other polarized surface opposing to the one having said cavity on the side of said fulcrum, said further cavity extending substantially coaxially with said cavity and having a smaller diameter than that of said cavity.

11. The cartridge according to claim 10 wherein said magnetic circuit comprises a substantially bar-shaped permanent magnet and a pair of pole pieces respectively coupled at one end to each pole end of said magnet and forming at a part adjacent the other end extending substantially parallelly with each other said magnetic gap, and said cavities are provided in the respective said pole pieces so as to penetrate them at said part adjacent the other end.

12. The cartridge according to claim 10 wherein said magnetic circuit comprises a substantially bar-shaped permanent magnet and a pair of pole pieces respectively coupled at one end to each pole end of said magnet and forming at a part adjacent the other end extending substantially parallelly with each other said magnetic gap, and the respective said cavities are substantially cylindrical holes respectively penetrating through said part adjacent the other end of each pole piece.

13. The cartridge according to claim 10 wherein said magnetic circuit comprises a substantially bar-shaped permanent magnet and a pair of pole pieces respectively coupled at one end to each pole end of said magnet and forming said magnetic gap at a part adjacent the other end extending substantially parallelly to each other, both of said cavities are substantially cylindrical holes respectively penetrating through said part adjacent the other end of each pole piece, and said bobbin supporting means is of a shape capable of being fixed as fitted in said cylindrical hole in the pole piece on the side of said fulcrum for the bobbin rotation.

14. The cartridge according to claim 10 wherein said cavities in the magnetic circuit respectively penetrate through a part of the circuit which has each of said magnetized surfaces forming the magnetic gap, said bobbin supporting means is fixed as fitted in one of said cavities on the side of said bobbin rotation fulcrum, and said cantilever is of a linear shape and freely passed through said penetrating cavity of the smaller diameter so as to extend said end having said stylus out of the magnetic circuit and to couple said the other end to the bobbin at the center thereof on the side reverse to the side of said fulcrum.

15. The cartridge according to claim 9 wherein said magnetic circuit comprises a substantially bar-shaped permanent magnet and a pair of pole pieces coupled respectively at one end to respective ends of said magnet and forming said magnetic gap respectively at a surface adjacent the other end extending substantially parallelly with each other, and said cavity penetrates through one of said pole pieces on the fulcrum side adjacent said the other end thereof and substantially coaxially with said axial line of the fluxes.

16. The cartridge according to claim 9 wherein said cavity and fulcrum for the rotation of bobbin are positioned on the side of said S-pole magnetized surface.

17. The cartridge according to claim 9 wherein said fulcrum for the rotation of bobbin and cavity are positioned on the side of said N-pole magnetized surface.

18. The cartridge according to claim 9 wherein said bobbin supporting means has an outer shape capable of being fixed as fitted in said cavity in the magnetic circuit.

19. The cartridge according to claim 9 wherein said magnetic circuit comprises a substantially bar-shaped permanent magnet and a pair of pole pieces respectively of an L-shape coupled at an end of its linear section to each of N and S poles of said magnet and forming between the other end surfaces of its bent section said magnetic gap, said cavity in the magnetic circuit is a hole penetrating through one of said pole pieces at its said the other end of the bent section, and said magnetic circuit is provided with a further hole in the other pole piece opposing said pole piece having said hole, said further hole penetrating through said bent section with a smaller diameter than said hole and being arranged to be substantially coaxial with said hole and magnetic fluxes in the gap.

20. The cartridge according to claim 19 wherein each of said pair of pole pieces has a substantially square section at least at said the other end of the bent section, each of said holes of larger and smaller diameters is substantially of a cylindrical shape, and said bobbin supporting means is a cylindrical member having a diameter capable of being fixed as fitted in said larger diameter hole in the pole piece on the side of the fulcrum for bobbin rotation.

21. The cartridge according to claim 19 wherein each of said pair of pole pieces has a substantially square section at least at said the other end of the bent section, each of said holes of larger and smaller diameters is substantially of a cylindrical shape, said fulcrum for the bobbin rotation is disposed adjacent said end surface of the pole piece on the S-pole side, said bobbin supporting means is a cylindrical member having a diameter capable of being fixed as fitted in said larger diameter hole in the bent section of said pole piece on the S-pole side, and said cantilever is substantially of a linear shape and freely passed through said smaller diameter hole in said bent section of the pole piece on the N-pole side so that said end having the stylus will extend out of said pole piece on opposite side to the magnetic gap while the cantilever is passed through said bobbin along the center axis thereof so as to be fixed thereto adjacent the other end extended out of the bobbin and said the other end will be coupled to said supporting means in a rotatable manner to form said fulcrum.

22. The cartridge according to claim 9 wherein said bobbin supporting means is of a shape with which the means can be fitted tightly into said cavity in the magnetic circuit, and said cantilever comprises a hollow pipe penetrating through said bobbin at its center, said cantilever being fixed adjacent said the other end to the bobbin and coupled at the other end to the center of said bobbin supporting means through a resilient wire fixed at an end into hollow opening of the other end of the cantilever.

23. An moving coil-type cartridge comprising in combination, a permanent magnet having a pair of pole pieces forming a magnetic gap between said pole pieces, a cantilever of non-magnetic material, a stylus on one end of said cantilever, supporting means for the other end of said cantilever, said supporting means being affixed to one of said pole pieces and including a fulcrum disposed substantially along the central axis of the magnetic gap, a bobbin of non-magnetic and electrically insulative material having a pair of parallel opposed surfaces and a central axis intersecting said surfaces, said bobbin being mounted on said cantilever substantially in the center of said magnetic gap, the central axis of said bobbin substantially coinciding with said cantilever so that one of said parallel surfaces is on the fulcrum side of said magnetic gap and the other of said parallel surfaces is on the remote side of said magnetic gap, deflection of said cantilever causing said bobbin to rotate about said fulcrum as a center, at least a pair of coils wound on said bobbin with substantially parallel windings disposed on the fulcrum side and remote side parallel surfaces, the pole piece to which said supporting means is fixed having a cavity surrounding said fulcrum so that the magnetic flux lines within said gap will be directed away from said fulcrum, whereby the magnetic flux will intersect a greater number of windings on said remote side of the bobbin than on said fulcrum side of the bobbin, and rotation of the bobbin about the fulcrum as a center causing said windings on said remote side of the bobbin to transverse the flux at a greater velocity than the windings on the fulcrum side, thereby to increase the output signal produced by said cartridge.

* * * * *